United States Patent [19]

Zitzman

[11] 4,422,684

[45] Dec. 27, 1983

[54] APPARATUS FOR LIFTING REEL-LESS COILS OF WIRE

[76] Inventor: George E. Zitzman, 131 Tanners Pond Rd., Garden City, N.Y. 11530

[21] Appl. No.: 304,630

[22] Filed: Sep. 22, 1981

[51] Int. Cl.[3] ..... B66C 1/54

[52] U.S. Cl. ..... 294/97

[58] Field of Search ..... 294/86.24, 86.25, 93–98; 414/910, 911, 684

[56] References Cited

U.S. PATENT DOCUMENTS

| | | | |
|---|---|---|---|
| 1,282,479 | 10/1918 | Smith | 294/86.24 X |
| 1,492,970 | 5/1924 | Elliott | 294/86.24 |
| 4,083,593 | 4/1978 | Lynn | 294/97 |

FOREIGN PATENT DOCUMENTS

| | | | |
|---|---|---|---|
| 1016876 | 1/1966 | United Kingdom | 294/97 |

*Primary Examiner*—Johnny D. Cherry

*Attorney, Agent, or Firm*—Eisenman, Allsopp & Strack

[57] ABSTRACT

There is disclosed a lifting feature for releasably gripping from within the reel-less cores about which coils of wire in bulk are wound, the fixture including a central lifting member from which pivotally attached lifting bars radiate to engage the core in an upwardly inclined attitude so that the weight of the load causes the bars to press into the walls of the core to establish a solid coupling.

6 Claims, 3 Drawing Figures

APPARATUS FOR LIFTING REEL-LESS COILS OF WIRE

BACKGROUND OF THE INVENTION

Wire used in manufacturing operations, such for example as making small coiled springs, is fabricated and shipped in large coils typically weighing 1,000 pounds each. The coils are not wound on reels or spools but are typically wound with open cores which may include a paperboard sleeve. The coils are bound in their toroidal configuration with a number of circumferentially spaced metal straps. Handling such coils, which are known in the trade as "reel-less cores", is difficult. Typically, pallets are used into which the tines of a fort lift truck can be inserted. Special rigging, however, is required if the coil is to be lowered, for example, into a hopper or a spring forming machine. Such devices can include grappling hooks, which are apt to damage the coil or its straps, or pressure inflatable bladder devices to grip the inside of the core but which are vulnerable to tearing or to loss of pressure and hence sudden failure at unexpected moments.

The present invention has for its object to provide a device for gripping heavy coils of wire in reel-less core form so that they can be handled from above by any standard lifting device such for example as a chain fall, block and tackle or the raised tines of a fort lift.

SUMMARY OF THE INVENTION

In accordance with the invention a lifting tool or device is provided which can be fitted into the hollow core of a wire coil. A central lifting post aligns itself coaxially with the coil and projects above the top surface to present an eye for a lifting hook as well as a pair of laterally spaced wings for receiving, on either side of the post the two parallel tines of a fork lift. The lower end of the post has attached thereto, through a thrust bearing, a central hub carrying a plurality of radially extending flat bars in a pivotal coupling allowing them to be pushed upward when entering the core. The bars are squared off at their ends and are so dimensioned that they slightly exceed the inside diameter of the hollow core when disposed horizontally. When tension is placed on the central lifting column, the flat bars which are then inclined upward, bind in the walls of the core as they pivot downward under the lifting stresses, thus pressing harder into the core to secure the device to the load. A cross beam extending diametrically across the core space is, within limits, movable vertically with respect to the central column and carries by its outer ends a metal ring or annulus which underlies the radially projecting bars and precludes pivotal displacement below the horizontal plane which would release the load. In order to release the fixture from the load, a lifting ring is movably supported beneath the radially extending bars. The ring includes an upwardly extending handle or bail, the center of which is formed with a small ring loosely surrounding the central lifting post to allow vertical movement. When the bail is pulled up sharply, the lifting ring will stress the radial bars upwardly disengaging them from the indented wall of the core. Other features and advantages of the invention will be understood from the following description of a preferred embodiment described in conjunction with the accompanying drawings.

DESCRIPTION OF THE PREFERRED EMBODIMENT

Figure 1:
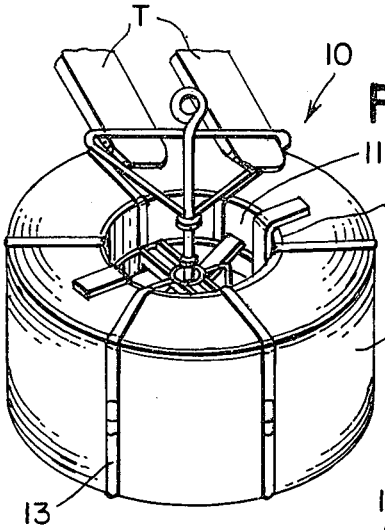
FIG. 1 is a view in perspective of a coil of wire of reel-less core form into which the tool of the present invention has been inserted.

In accordance with the invention, there is provided a lifting device or fixture 10 for facilitating the handling of heavy coils of wire in the form of reel-less core coils such as that identified by numeral 11 in FIG. 1. The hollow cylindrical core 11*a* can include a heavy paperboard liner 12 (also shown in FIG. 2) which together with the convolutions of wire is bound in place by a plurality of circumferentially spaced apart straps 13. It is in this form that wire is frequently prepared for shipment by the manufacturer for processing by others into finished products such for example as coiled wire springs. A typical reel-less core coil of wire weighs 1,000 pounds and is an unwieldy object to handle. As seen in FIG. 1, the lifting fixture 10 is in place in the coil and the assembly is shown hoisted from the ground by the tines T of a fork lift truck.

Figure 2:
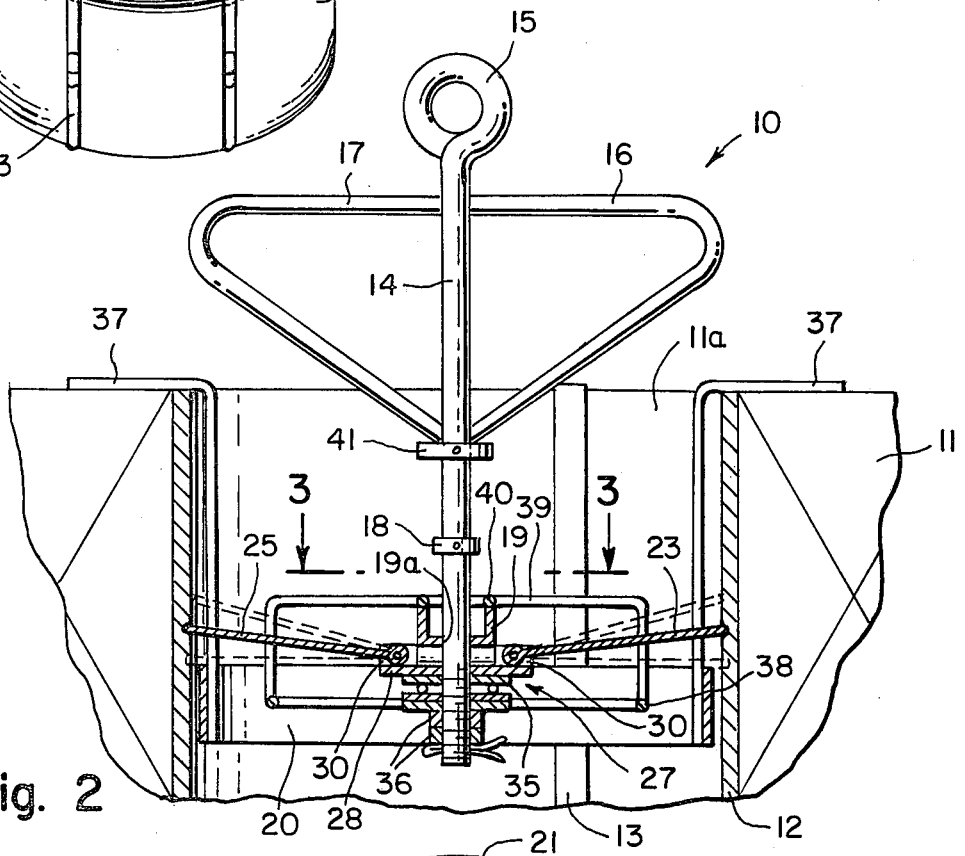
FIG. 2 is a view in vertical section of the lifting tool.
Figure 3:
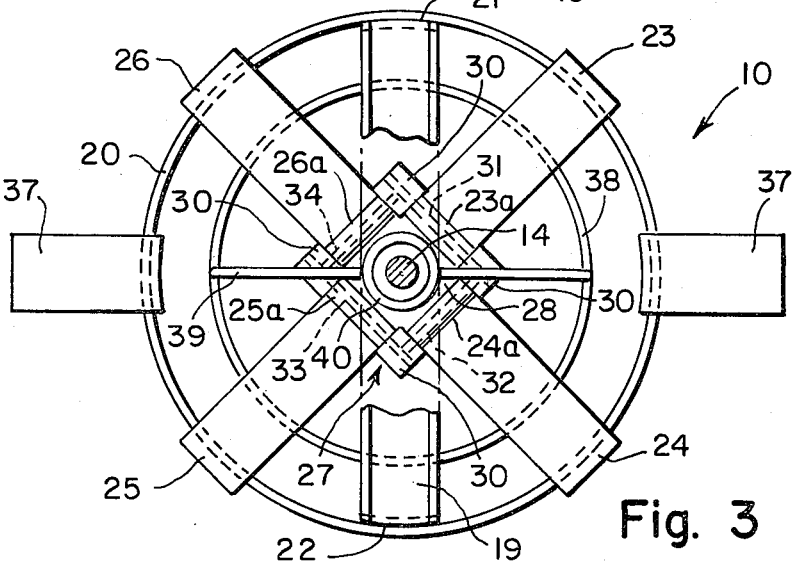
FIG. 3 is a top view of the lifting tool taken in cross section on the line 3—3 of FIG. 2.

Referring to FIG. 2, the lifting fixture 10 includes a central tension rod 14 having a lifting eye 15 at its upper end (to receive the hook of a conventional hoist, not shown) and a pair of lateral lifting wings 16 and 17, each shaped in triangular form and welded to the tension rod 14 at axially spaced-apart points to define openings to receive the tines of a fork lift. Secured to the tension rod 14 by means, for example of set screws, is a stop collar 18 which defines the upper limit of movement of a transverse beam 19 having a central aperture 19*a* through which the rod 14 passes. The beam 19 is attached at its ends to a metal annulus 20 by means of depending welded pads 21 and 22.

Also mounted on the tension rod 14 is an array of four radially extending lifting bars 23, 24, 25 and 26 joined to a central hub assembly 27 through which the tension rod 14 passes. The outer ends of the arms overlie the annulus 20. The hub assembly 27 includes in addition to the lifting bars a pad 28 having four short, square corner posts 30. Transverse sleeves 23*a*, 24*a*, 25*a* and 26*a* are respectively joined to the bars 23, 24, 25 and 26 at their inner ends. Pivot pins 31, 32, 33 and 34 pass through the respective sleeves and are secured in the corner posts 30. The pins 31 and 33 pass through the posts and are secured externally while the pins 32 and 34, having been fitted first, are captured by the first pair. A thrust bearing 35, positioned adjustably on the threaded tension rod 14 by nut and lock nut assembly 36, supports the hub 27 and its lifting bars 23–26 and affords rotary movement for correct positioning.

The diameter of the radially aligned lifting bars 23–25 and 24–26 is slightly in excess of the inside diameter of the hollow cylindrical core 11*a*. When the fixture is dropped into place within the core, the bars swing upward to ease the entry. The fixture comes to rest within the core 11*a* when angle irons 37 engage the top of the coil. In this position, the lifting eye 15 and lifting wings 16 and 17 are disposed above the coil and the transverse carrier beam 19 will have engaged the adjustable stop collar 18 from below. When tension is applied to the rod 14, either through the eye 15 by means of a hoist hook or by means of the tines of a fork lift, the squared-off outer ends of the lifting bars will press into the walls of the core as stress increases until the load is lifted with the bars seeking an intermittent angle above the horizontal. Under such conditions the lifted mass becomes firmly attached by the fixture to the lifting mechanism and may thus be transported or maneuvered into position for processing. Increased forces act to increase the binding action. The bars are precluded from overcentering or passing the horizontal plane by the annulus 20 which will arrest the downward movement when its carrier beam 19 engages the hub assembly 27.

In order to remove the fixture 10 when the load is in place at its destination, the rod 14 is first freed of tension. A metal lifting ring 38 disposed coaxially within the annulus 20 and underlying the flat lifting bars 23–26 is raised by pulling upwardly on a U-shaped bracket or handle 39 welded at its ends to the lifting ring and extending upwardly to pass over the transverse beam 19. The handle 39 is formed with a central eye 40 through which the tension rod 14 freely passes. In this fashion, the lifting ring 38 is supported by the beam 19 when not in use but may be actuated manually or by a hoist to free the fixture from the coil. The upward movement of the lifting ring relatively to the tension rod is limited by a stop collar 41 fixed to the tension member and adapted to engage the eye 40.

While the invention has been described above having reference to a preferred embodiment, it will be understood that it can take other forms and arrangements within the scope of the invention and should not therefore be regarded as limited except as defined in the following claims.

I claim:

1. A lifting fixture for operation within cores comprising a central tension member adapted to be placed within the core and to be connected at its upper end to a carrier device; and a plurality of lifting bars coupled to the tension member for deflection about axes transverse to the axis of the tension member and extending radially outward the engage the inner wall of the core in an upwardly inclined position, whereby when the tension member is stressed for lifting the bars deflect to press their ends into the walls of the core, means to limit the downward deflection of the lifting bars comprising an annulus underlying the free ends of the bars and movable axially on the central tension member and stop means on the tension member to afford limited movement of the annulus axially of the tension member.

2. A lifting device as set forth in claim 1 including a lifting eye at the upper end of the tension member to receive a hoist hook and a pair of laterally extending lifting members to be engaged by the tines of a fork lift.

3. A lifting fixture as set forth in claim 1 including releasing means for detaching the lifting bars from the inner wall of the core comprising a lifting ring member disposed concentrically within the said annulus beneath the lifting bars and supported for vertical movement on the tension member whereby raising the lifting ring member deflects the lifting bars upwardly to increase the upward inclination thereof to free the ends of the lifting bars from the inner wall of the core.

4. A lifting fixture as set forth in claim 3 including a U-shaped handle attached to the lifting ring member, said handle having a central opening through which the tension member passes freely and stop means on the tension member to arrest the upward movement of the ring.

5. A lifting device as set forth in claim 1 including positioning members extending upward from the annulus and having outwardly extending arms to overlie the top of the core.

6. A lifting fixture as set forth in claim 1 including a central carrier for supporting the lifting bars, said tension member passing through said carrier with clearance to allow the carrier to move axially and rotatably with respect to the tension member, and a rotary thrust bearing coupling the underside of the carrier to the lower end of the tension member.

* * * * *